United States Patent [19]

Michaels

[11] 4,245,881

[45] Jan. 20, 1981

[54] ELECTRICAL CONNECTOR

[75] Inventor: Leonard H. Michaels, Warrenville, Ill.

[73] Assignee: Brad Harrison Co., LaGrange, Ill.

[21] Appl. No.: 972,343

[22] Filed: Dec. 22, 1978

[51] Int. Cl.[3] ..... H01R 11/22

[52] U.S. Cl. ..... 339/256 R; 339/74 R; 339/143 R

[58] Field of Search ..... 339/256 R, 256 RT, 256 S, 339/262 R, 255 RT, 252 R, 252 P, 241, 253 R, 143 R, 95 R, 74 R

[56] References Cited

U.S. PATENT DOCUMENTS

| | | | |
|---|---|---|---|
| 3,380,017 | 4/1968 | Gomulka | 339/256 S X |
| 4,039,238 | 8/1977 | Johnson, Jr. et al. | 339/95 R |

*Primary Examiner*—Roy Lake
*Assistant Examiner*—DeWalden W. Jones
*Attorney, Agent, or Firm*—Mason, Kolehmainen, Rathburn & Wyss

[57] ABSTRACT

An electrical connector embodying a housing having an elongated cavity therein for removably receiving an elongated plug in the cavity, with an elongated spiral spring member mounted in the cavity, in longitudinal alignment therewith, in position to receive the plug into the spring and afford the electrical connection between the housing and the plug.

14 Claims, 6 Drawing Figures

ELECTRICAL CONNECTOR

BACKGROUND OF THE INVENTION

This invention relates to electrical connectors, and, more particularly, to electrical connectors of the plug-together type.

The primary object of the present invention is to afford a novel electrical connector.

Another important object of the present invention is to afford a novel electrical connector of the plug-together type.

Another object of the present invention is to afford a novel electrical connector of the type embodying a female member having a cavity therein and a male member adapted to be inserted into the cavity in the female member, with a novel annular member mounted in the cavity and constituted and arranged in a novel and expeditious manner effective to enable the male member to be quickly and easily inserted into and removed from the female member.

An object ancillary to the foregoing is to afford a novel electrical connector of the aforementioned type wherein the annular member is constituted and arranged in a novel and expeditious manner to afford an effective electrical interconnection between the female member and the male member when the male member is disposed in operative position in the female member.

Electrical connectors embodying a female member having a cavity therein and a male member adapted to be inserted into and removed from the cavity, with an annular member disposed in the cavity for reception of the male member therein have been heretofore known in the art, being shown, for example, in U.S. Pat. Nos. 3,107,966, 3,141,723, 3,278,890, 3,453,587, 3,861,595, 3,861,776, 4,033,654 and 4,039,238. It is another important object of the present invention to afford improvements over electrical connectors of the aforementioned type heretofore known in the art.

Another object of the present invention is to afford a novel electrical connector of the type embodying a female member having a cavity therein and a male member adapted to be inserted into the cavity, with an annular member disposed in the cavity in position to receive the male member therein, and wherein the annular member is in the form of a novel, elongated, sleeve-like member constituted and arranged in a novel and expeditious manner in the cavity.

An object ancillary to the foregoing is to afford a novel electrical connector of the aforementioned type, wherein the annular member is in the form of a spiral spring disposed in the cavity in substantially axial alignment therewith.

Another object of the present invention is to afford a novel electrical connector of the aforementioned type, wherein the annular member is in the form of an elongated spiral spring, the convolutions of which are of polygonal shape internally and externally.

A further object of the present invention is to afford a novel electrical connector of the aforementioned type, wherein the polygonal shaped convolutions of the spring have an inside diameter that is less than the outside diameter of the male member, when the latter is in withdrawn position relative to the female member, and wherein the convolutions are expanded outwardly by the male member into firm engagement with the portions of the female member surrounding the cavity therein, when the male member is disposed in operative position in the female member.

Another object of the present invention is to afford a novel electrical connector of the aforementioned plug-together type which is practical and efficient in operation, and which may be readily and economically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figures 1, 2, 3, 4, 5, 6:
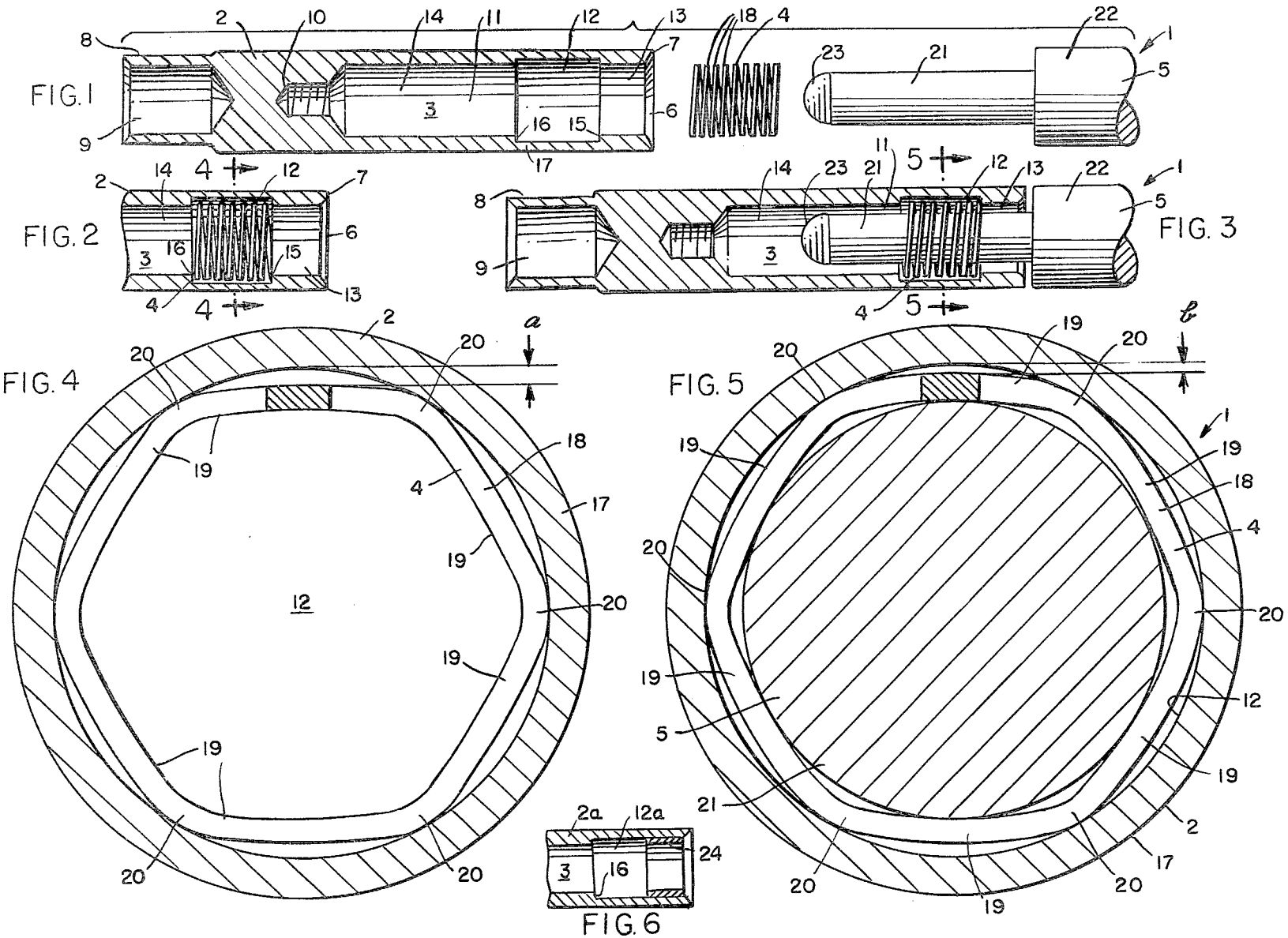
FIG. 1 is an exploded view of an electrical connector embodying the principles of the present invention.
FIG. 2 is a fragmentary, sectional view of the female portion of the electrical connector shown in FIG. 1, showing the annular member of the electrical connector disposed in operative position in the female member.
FIG. 3 is a sectional view through the female member of the electrical connector shown in FIG. 1, with the parts of the connector disposed in connected-together relation to each other.
FIG. 4 is an enlarged detail sectional view taken substantially along the line 4—4 in FIG. 2.
FIG. 5 is an enlarged, detail sectional view taken substantially along the line 5—5 in FIG. 3.
FIG. 6 is a fragmentary sectional view of an alternative form of the female portion of the connector.

An electrical connector 1, embodying the principles of the present invention, is shown in the drawings to illustrate the presently preferred embodiment of the present invention.

In general, the electrical connector 1 embodies a female member or receptacle in the form of an elongated sleeve or housing 2 having an elongated cavity 3 therein; with an annular member in the form of a spiral spring 4 mounted in the cavity 3; and with a male member, in the form of an elongated pin or plug 5 adapted to be moved into and out of operative position in the cavity 3, in which operative position it is disposed in the spring 4, as shown in FIG. 3.

The housing 2 is an elongated member, with the cavity 3 extending longitudinally therealong from an opening 6 in one end 7 thereof toward the other end portion 8 of the housing 2. The end portion 8 of the housing 2 has a cavity 9 formed therein for receiving an end portion of an electrical conductor, not shown, to which the housing 2 may be connected in the usual manner, such as, for example, soldering, or the like. The cavity 3 terminates at its inner end 10 in inwardly spaced relation to the cavity 9.

The cavity 3 has one portion 11 extending inwardly from the opening 6, which is substantially cylindrical throughout its length. The portion 11 embodies an intermediate portion 12 disposed between an outer end portion 13 and an inner end portion 14, in inwardly spaced relation to the opening 6. The end portions 13 and 14 are of the same diameter, and the intermediate portion 12 is of a larger diameter, the outer and inner ends thereof being defined by inwardly projecting shoulders 15 and 16, formed by the junction of the intermediate portion with the end portions 13 and 14, respectively, FIG. 1.

In the assembled electrical connector 1, the spring 4 is disposed in the intermediate portion 12 of the cavity 3, FIGS. 2 and 3. In the preferred form of the present invention, the outside diameter of the spring 4 is such that in its normal, unactuated condition the outer periphery thereof engages the inner surface of the portion of the sidewall 17 of the housing 2, defining the outer periphery of the portion 12 of the cavity 3, with a relatively loose, frictional fit but, if desired, the spring 4 may be of such outside diameter that it is disposed in the portion 12 of the cavity 3 with a sloppy fit without departing from the purview of the broader aspects of the present invention, as will be discussed in greater detail presently.

The outside diameter of the spring 4, in unactuated position, is greater than the inside diameter of the shoulders 15 and 16, so that when the spring 4 is disposed in the aforementioned operative position in the portion 12 of the cavity 3, the shoulders 15 and 16 constitute retaining means for holding the spring 4 against axial movement out of the portion 12 of the cavity 3. The spring 4 may be inserted into the portion 12 of the cavity 3 by pressing it inwardly through the opening 6 in the end of the housing 2, which is chamfered outwardly to thereby constrict and reduce the diameters of the convolutions 18 of the spring 4 to that of the end portion 13 of the cavity 3, so that the spring 4 may be pressed longitudinally inwardly through the end portion 13 into the portion 12 of the cavity 3, wherein it again expands radially outwardly to be disposed in the aforementioned assembled position relative to the housing 2, shown in FIG. 2.

The convolutions 18 of the spring 4 are polygonal in shape, each embodying a plurality of substantially straight portions or flats 19 interconnected to each other by outwardly-convex curved portions or arcs 20, FIGS. 4 and 5. With this construction, the outer peripheral surfaces of the arcs 20 define the extreme outside diameter of the convolutions 18 of the spring 4, and the inner peripheral surfaces of the flats 19 define the extreme inner diameter of the convolutions 18 of the spring 4. In the assembled position of the spring 4, shown in the drawings, relative to the housing 2, it is the outer peripheral surfaces of the arcs 20 that engage the inner peripheral surface of the portion of the sidewall 17 that defines the outer periphery of the portion 12 of the cavity 3.

The plug 5 shown in the drawings embodies a substantially cylindrical-shaped proximal end portion 21 projecting forwardly from a substantially cylindrical-shaped body portion 22, having a larger diameter than the end portion 21, with the front end or free end 23 of the end portion 21 being convex-outwardly in a forward direction to afford a rounded, narrow end for guiding the end portion 21 into the housing 2. The body portion 5 may be connected to a suitable electrical conductor, not shown, in any suitable manner, well-known in the art, such as, for example, soldering it thereto, for connection to the aforementioned electrical conductor, not shown, which may be mounted in the cavity 9 in the housing 2, when the plug 1 is inserted into operative position in the housing 2, as will be discussed in greater detail presently. As will be appreciated by those skilled in the art, the plug 5, shown in the drawings, is of a type well-known in the art and is shown herein by way of illustration and not by way of limitation, and other shapes and forms of plugs may be used in place thereof, which would be suitable for use in my novel electrical connector, without departing from the purview of the broader aspects of the present invention.

The housing 2 and the plug 5 may be made of any suitable material, but preferably, are made from brass or copper bar stock, and are silver plated. Similarly, the spring 4 may be made of any suitable material, but, preferably, is made of beryllium copper and is silver plated. In the preferred form of the present invention shown in the drawings, the convolutions 18 of the spring 4 have six flats 19. However, as will be appreciated by those skilled in the art, this is merely by way of illustration of the preferred form of the present invention and other polygonal shapes of the convolutions 18, having three or more flats may be used without departing from the purview of the broader aspects of the present invention.

In the preferred form of the present invention, the outside diameter of the end portion 21 of the plug 5 is such, relative to the extreme inside diameter of the unactuated spring 4 that the end portion 21, when it is inserted through the opening 6 in the housing 2 into operative position in the latter, as shown in FIG. 3, will be relatively easily moved into the spring 4, one convolution at a time, but, in such a manner that, when it is disposed in the aforementioned operative position in the housing 2, it is effective to firmly engage the inner periphery of the spring 4 and hold the outer periphery thereof in firm engagement with the inner surface of the sidewall 17 of the housing 2. Preferably, the diameters of the portions 13 and 14 of the cavity 3 in the housing 2 are such that these portions of the housing 2 are not engaged by the end portion 21 of the plug 5 during insertion of the latter into and removal of the latter from operative position in the housing 2.

As an example of the relative sizes of the spring 4 and the end portion 21 of the plug 5 that may be used to afford an effective electrical connector, I have found that if the spring 4 is constructed of 0.030" diameter wire, with the outside diameter of the convolutions 18 being 0.680", and the diameter of the end portion 21 of the plug 5 being such that when it is inserted into operative position in the housing 2, it is effective to expand the convolutions 18 outwardly in such a manner as to deflect the flats 19 outwardly into position to reduce the space "a" shown in FIG. 4, from 0.030" to a space "b," shown in FIG. 5, of 0.015", for example, a highly desirable, practical and effective electrical connector 1 is afforded. With this construction, the spring 4 is effective to afford highly efficient electrical connection between the housing 2 and the plug 5, when the plug 5 is disposed in operative position relative to the housing 2, while permitting the plug 5 to be readily inserted into and removed from operative position in the housing 2.

With the aforementioned construction, during insertion of the plug 5 into operative position in the housing 2, the opening forces applied thereby on the sring 4 are applied one convolution at a time. Once each individual loop 18 is opened, it produces a minimal frictional force to the further insertion of the plug 5 into the housing 2, because of the smooth radius offered by the wire diameter. However, once the plug 5 is inserted into operative position in the housing 2, it is highly effectively connected thereto, the several convolutions 18 of the spring 5 affording a plurality of closely adjacent, independent current paths between the housing 2 and the plug 5. Thereafter, if it is desired to disconnect the housing 2 from the plug 5, the plug 5 may be pulled outwardly through the spring 4 and the cavity 3.

An alternative form of female socket is shown in FIG. 6, wherein it is illustrated as being made of two pieces. In this construction the housing 2*a* has the opening 3 provided with the annular shoulder 16, as in FIGS. 1, 2 and 3, but the portion 12*a* of larger diameter extends all the way to the end, and the spring is inserted and then retained therein by the ring 24.

From the foregoing it will be seen that the present invention affords a novel electrical connector which may be quickly and easily connected and disconnected.

In addition, it will be seen that the present invention affords a novel electrical connector wherein, when the parts thereof are operatively connected together, good electrical connection is made between the aforementioned parts.

In addition, it will be seen that the present invention affords a novel electrical connector which is practical and efficient in operation, and which may be readily and economically produced commercially.

Thus, while I have illustrated and described the preferred embodiment of the present invention, it is to be understood that this is capable of variation and modification, and I therefore do not wish to be limited to the precise details set forth, but desire to avail myself of such changes and alterations as fall within the purview of the following claims.

I claim:

1. An electrical connector comprising a. a male member having an elongated electrically conductive proximal end portion, b. a receptacle formed of conductive material and having an elongated cavity opening outwardly through one side thereof for receiving said end portion, c. said cavity having a transverse cross sectional size that is larger than the transverse cross sectional size of said end portion, d. annular conductive means mounted in said cavity, e. said annular means having (1) a polygonal outside peripheral surface, (2) a polygonal inside peripheral surface, and (3) a normal position in said cavity wherein the inner cross sectional size of said annular means is less than the transverse cross sectional size of said male member, and f. said end portion of said male member being longitudinally movable into and out of said annular means to thereby expand said annular means outwardly from said normal position into firm engagement and electrical contact with said receptacle and to thereby permit said annular means to move back into said normal position, respectively.

2. An electrical connector as defined in claim 1, and in which a. said annular means comprises an elongated spiral spring.

3. An electrical connector as defined in claim 2, and in which a. said end portion of said male member has a convex free end that slopes to a smaller cross sectional size than said cross sectional size of said annular means when the latter is in said normal position thereof, and b. said free end is the leading end of said male member when said proximal end portion of said male member is so moved into said annular means.

4. An electrical connector comprising a. a female member formed of conductive material and having a side wall portion defining an elongated cavity having an end opening outwardly through one side of said member, b. an elongated male member formed of conductive material movable longitudinally into and out of operative position in said cavity through said end of the latter, and c. a conductive spiral spring having a plurality of convolutions, d. said spiral spring being mounted in said cavity in position (1) wherein said convolutions are disposed substantially in axial alignment with said cavity, and (2) to dispose said convolutions in wrapped-around engagement with said male member when the latter is disposed in said operative position in said cavity, e. said convolutions having (1) one position, when said male member is disposed out of said engagement therewith, wherein they are noncircular and of smaller internal width than the outer transverse width of said male member, and (2) another position, when said male member is disposed in said operative position in said cavity, wherein they are expanded outwardly by said male member into firm engagement and electrical contact with said side wall portion of said female member.

5. An electrical connector as defined in claim 4, and in which a. said cavity has an intermediate portion disposed (1) between two oppositely disposed adjacent portions, and (2) in inwardly spaced relation to said opening, b. said intermediate portion is larger in transverse cross section than said adjacent portions, and c. said spiral spring is disposed in said intermediate portion.

6. An electrical connector as defined in claim 4, and in which a. said cavity has an end portion (1) which is substantially cylindrical in shape, and (2) in which said male member is disposed when the latter is disposed in said operative position, b. said end portion of said cavity has one portion disposed (1) between two oppositely disposed other portions, and (2) in inwardly spaced relation to said opening, c. said one portion is larger in diameter than said other portions, and d. said sprial spring is (1) disposed in said one portion, and (2) polygonal in internal and external transverse cross sectional shape.

7. An electrical connector as defined in claim 4, and in which a. said cavity has an end portion (1) which is substantially cyclindrical in shape, and (2) in which said male member is disposed when the latter is disposed in said operative position, b. spaced retaining means are disposed in said end portion, and c. said spiral spring is disposed in said end portion between said spaced retaining means.

8. An electrical connector as defined in claim 7, and in which a. said convolutions are polygonal in shape.

9. An electrical connector as defined in claim 8, and in which a. said male member is substantially round in transverse cross section, b. said convolutions embody a plurality of flats interconnected by convex-outwardly arcs, and c. the inside diameter of said convolutions, between oppositely disposed ones of said flats, is less than the outside diameter of said male member when said convolutions are in said one position thereof.

10. An electrical connector as defined in claim 9, and in which a. said spring is disposed in said end portion with a loose fit when said convolutions are disposed in said one position thereof, and b. said arcs are disposed in said firm engagement with said side wall portion of said female member when said convolutions are disposed in said other position thereof.

11. An electrical connector assembly comprising:

a male pin member formed of electrically conductive material;

a female socket defining member formed of electrically conductive material;

the socket defined by said female member having an internal diameter larger than the diameter of said male pin member;

an annular contact means disposed within said socket for establishing electrical contact between said pin member and said socket defining member upon insertion of said pin member into said socket; and the improvement in accordance with which said contact means comprises a spring having multiple convolutions of conductive material, said convolutions each adapted to encircle said pin member, said convolutions being noncircular and the minimum inside diameters of said convolutions being smaller than the diameter of said male pin member.

12. The connector assembly of claim 11 wherein said convolutions include flats and arc portions.

13. The connector assembly of claim 12 wherein said arc portions engage the wall of said socket prior to insertion of said pin member into said socket.

14. The connector of claim 11 wherein said socket includes a first segment wherein said contact means is located and additional second segments on both sides of and having smaller diameters than said first segment for capturing said contact means within said socket.

* * * * *